US005754988A

United States Patent [19]

Presa

[11] Patent Number: 5,754,988

[45] Date of Patent: May 26, 1998

[54] HEATED BIDET DEVICE

[76] Inventor: Carolyn V. D. Presa, Morgan Heights 193 Cleo Rand Ave., San Francisco, Calif. 94124

[21] Appl. No.: 878,806

[22] Filed: Jun. 19, 1997

[51] Int. Cl.[6] ..... A47K 7/08

[52] U.S. Cl. ..... 4/443; 4/448; 4/420.2; 4/420.4

[58] Field of Search ..... 4/420.1–420.5, 4/443–448

[56] References Cited

U.S. PATENT DOCUMENTS

| | | | |
|---|---|---|---|
| 2,707,467 | 5/1955 | Pelzer et al. | 4/420.1 |
| 3,210,141 | 10/1965 | Thomas | 4/420.4 |
| 3,728,743 | 4/1973 | Hagopian | 4/448 |
| 4,360,934 | 11/1982 | Ishigami et al. | 4/420.2 |
| 4,371,993 | 2/1983 | Patrick | 4/448 |
| 4,622,704 | 11/1986 | Chung | 4/420.2 |
| 4,668,227 | 5/1987 | Kay | 4/420.1 |
| 4,995,121 | 2/1991 | Barker | 4/420.4 |
| 5,090,067 | 2/1992 | Cogdill | 4/420.2 |
| 5,295,274 | 3/1994 | Daniels et al. | 4/443 |
| 5,519,900 | 5/1996 | Gardner | 4/420.2 |

*Primary Examiner*—Charles R. Eloshway

[57] ABSTRACT

A heated bidet device including a housing member. The housing member has an interior wall that forms a water tank and a storage compartment within. An elongated water line has a first end coupled to the toilet water line and a second end coupled to the water tank. The elongated water line is capable of carrying water from the toilet water line to the water tank. Included is a device for heating the water stored within the water tank. Also, a tension rod is mounted within the storage compartment. The tension rod is capable of supporting a hose coupling with a pump capable of drawing water from the water tank and into the hose.

9 Claims, 3 Drawing Sheets

HEATED BIDET DEVICE

BACKGROUND OF THE INVENTION

1. Field of the Invention

The present invention relates to a heated bidet device and more particularly pertains to providing a personal hygiene device having a warm water spray and further being connected with the existing toilet.

2. Description of the Prior Art

The use of a bidet is known in the prior art. More specifically, bidets heretofore devised and utilized for the purpose of personal hygiene are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,596,058 to Nourbakhsh discloses a bidet attachment for water closets. U.S. Pat. No. 4,450,596 to Cohen discloses a rectal hygiene system. U.S. Pat. Des. No. 343,447 to Thaler and Avian discloses a bidet. U.S. Pat. No. 5,023,961 to Alonso discloses a bidet accessory. Lastly, U.S. Pat. No. 4,195,369 to Lesick discloses a portable bidet attachment.

In this respect, the heated bidet device according to the present invention substantially departs from the conventional concepts and designs of the prior art, and in so doing provides an apparatus primarily developed for the purpose of providing a personal hygiene device having a warm water spray and further being connected with the existing toilet.

Therefore, it can be appreciated that there exists a continuing need for a new and improved heated bidet device which can be used for providing a personal hygiene device having a warm water spray and further being connected with the existing toilet. In this regard, the present invention substantially fulfills this need.

SUMMARY OF THE INVENTION

In view of the foregoing disadvantages inherent in the known types of bidet now present in the prior art, the present invention provides an improved heated bidet device. As such, the general purpose of the present invention, which will be described subsequently in greater detail, is to provide a new and improved heated bidet device which has all the advantages of the prior art and none of the disadvantages.

To attain this, the present invention essentially comprises a generally rectangular housing member for positioning onto an toilet tank. The housing member has an interior wall forming a water tank and a storage compartment. The interior wall is interconnected to a top wall of the storage compartment. The water tank of the housing member has an upper peripheral flange therearound and an upright that is adjacent the peripheral flange. A lid 18 is positioned over the water tank and capable of engaging the upright. The storage tank has a door hingably mounted to a side. Also an elongated water line is provided. The elongated water line has a first end that coupled to the toilet water line and a second end that is coupled to the water tank. The elongated water line is capable of carrying water from the toilet water line to the water tank. Additionally a means for heating the water stored within the water tank is provided. A tension rod is mounted within the storage compartment. The tension rod has a wheel coupled thereto. The wheel is sized to have a hose wound therearound. The tension rod allows the hose to be uncoiled and automatically recoiled about the wheel when pulled and released by a user. The hose has an exterior end that is coupled with a sprayer head and an interior end that is coupled to a pump means. The pump means is mounted onto the interior wall of the housing member. The pump means is capable of drawing water from within the water tank for release through the sprayer when coupled with the hose. Lastly, a U-clip is provided. The U-clip is coupled to a side of the toilet tank and secured in position by the weight of toilet tank's lid, the U-clip supporting the sprayer of the hose between uses.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved heated bidet device which has all the advantages of the prior art bidets and none of the disadvantages.

It is another object of the present invention to provide a new and improved heated bidet device which may be easily and efficiently manufactured and marketed.

It is a further object of the present invention to provide a new and improved heated bidet device which is of a durable and reliable construction.

An even further object of the present invention is to provide a new and improved heated bidet device which is susceptible of a low cost of manufacture with regard to both materials and labor, and which accordingly is then susceptible of low prices of sale to the consuming public, thereby making such heated bidet device economically available to the buying public.

Still yet another object of the present invention is to provide a new and improved heated bidet device which provides in the apparatuses and methods of the prior art some of the advantages thereof, while simultaneously overcoming some of the disadvantages normally associated therewith.

Still another object of the present invention is to provide a personal hygiene device having a warm water spray and further being connected with the existing toilet.

Lastly, it is an object of the present invention to provide a new and improved heated bidet device including a housing member. The housing member has an interior wall that forms a water tank and a storage compartment within. An elongated water line has a first end coupled to the toilet water line and a second end coupled to the water tank. The elongated water line is capable of carrying water from the toilet water line to the water tank. Included is means for heating the water stored within the water tank. Also, a tension rod is mounted within the storage compartment. The tension rod is capable of supporting a hose coupling with a pump means capable of drawing water from the water tank and into the hose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
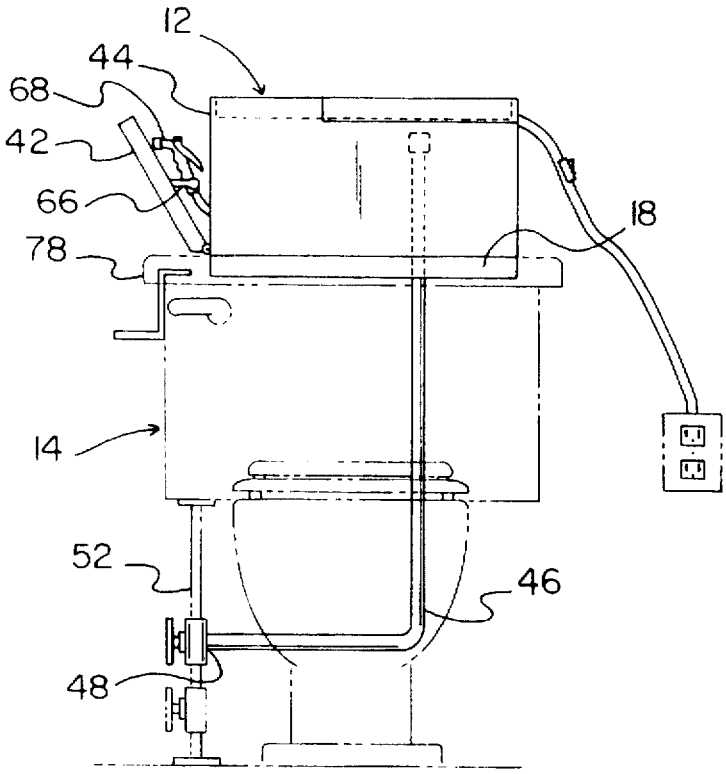
FIG. 1 is a perspective illustration of the preferred embodiment of the heated bidet device constructed in accordance with the principles of the present invention.

With reference now to the drawings, and in particular to FIG. 1 thereof, a new and improved heated bidet device embodying the principles and concepts of the present invention and generally designated by the reference numeral 10 will be described.

The present invention, the new and improved heated bidet device, is comprised of a plurality of components. Such components in their broadest context include a housing member, a hose and a water line. Such components are individually configured and correlated with respect to each other so as to attain the desired objective.

Figure 3:
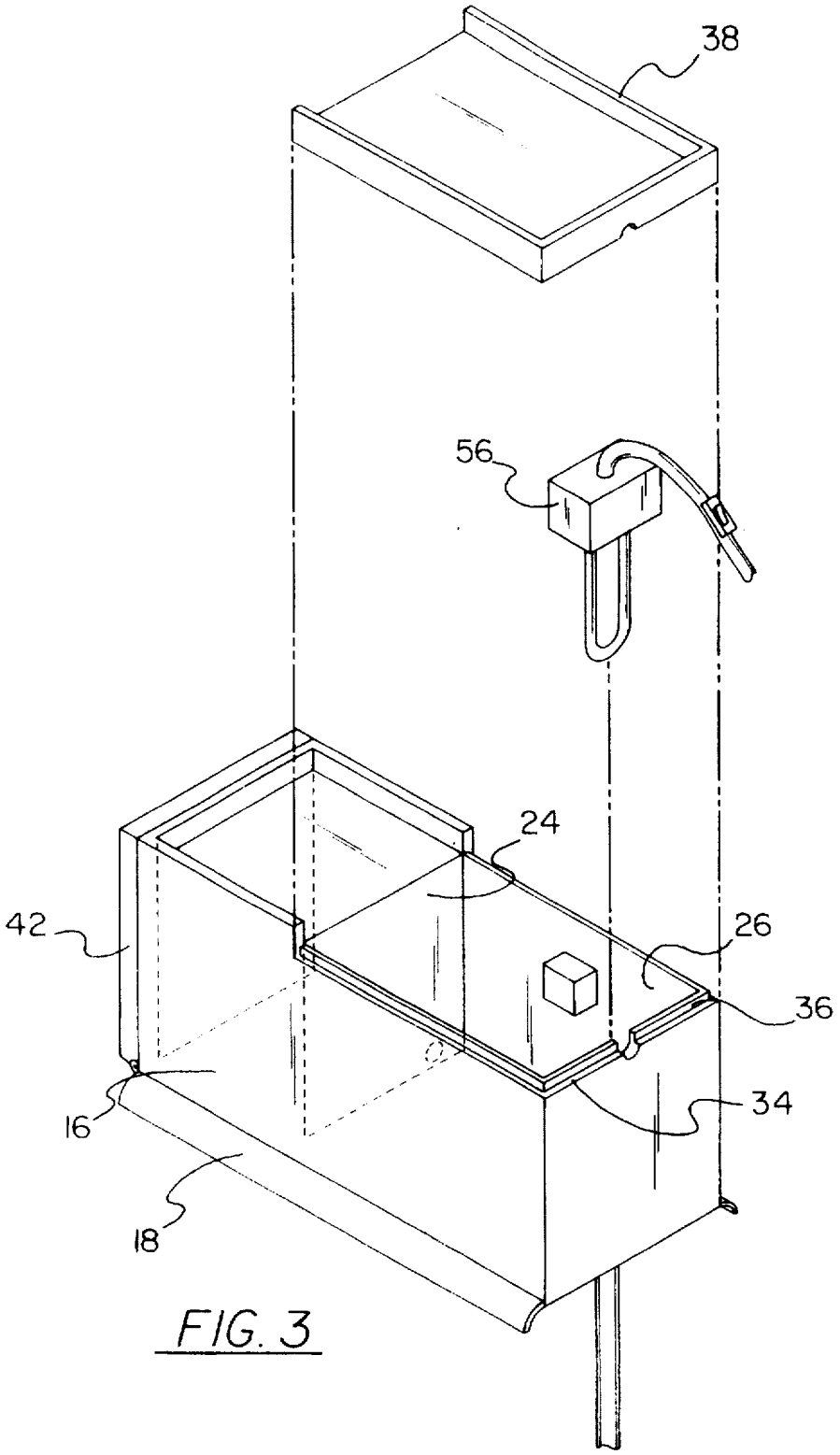
FIG. 3 is an exploded view of the operable components of the present invention.

More specifically, it will be noted that the heated bidet device includes a generally rectangular housing member 12 for positioning onto an toilet tank 14. Each side wall 16 has a lower extent 18 that is slightly convex so as to engage the upper side portion of the toilet tank lid, as shown in FIG. 1. The lower extent of each side wall holds the housing member in position. As shown in FIG. 3, the housing member has an interior wall 24. The interior wall divides the interior of the housing member into a water tank 26 and a storage compartment 28. The interior wall is interconnected to a top wall 32 of the storage compartment. The water tank of the housing member has an upper peripheral flange 34 therearound and an upright 36 that is adjacent the peripheral flange.

Figure 2:
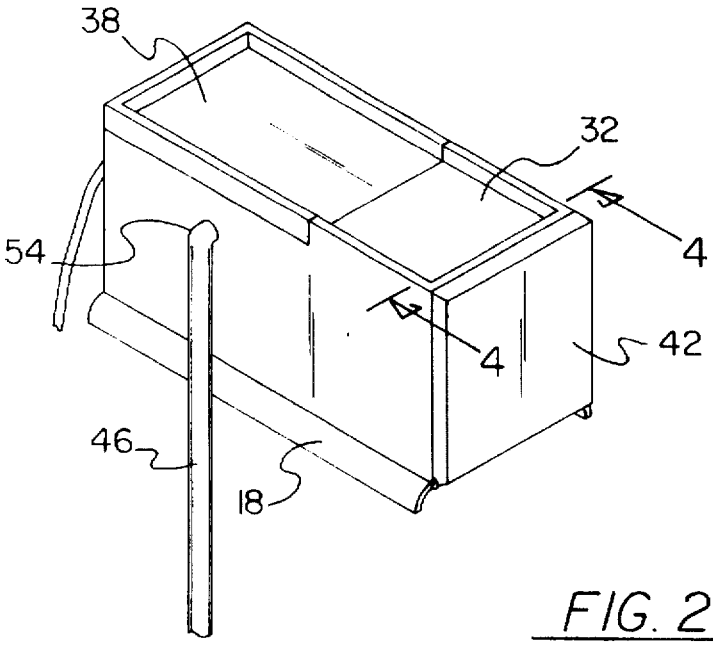
FIG. 2 is an isometric view of the present invention of FIG. 1.

As illustrated in FIG. 2, a lid 38 is provided. The lid is positioned over the water tank and engages the upright. When the lid is in position it is flush with the top wall of the storage compartment. Also, when the lid is in position the housing member is closed completely. The lid and top wall provides a place that can receive small items.

A door 42 is hingably coupled to a front side 44 of the storage compartment. As seen in FIG. 1, opening of the door allows access to the storage compartment. The hinge of the door is resilient so as to allow the door to automatically close.

Also, an elongated water line 46, as seen in FIG. 2, is provided. The elongated water line has a first end 48 coupled to the toilet water line 52 and a second end 54 that is coupled to the water tank 26. The elongated water line is capable of carrying water from the toilet water line to the water tank.

Additionally, a means 56 for heating the water stored within the water tank is included. Specifically the heating means is an immersion heater. The immersion heater has a power cord that plugs into a standard wall outlet.

Figure 4:
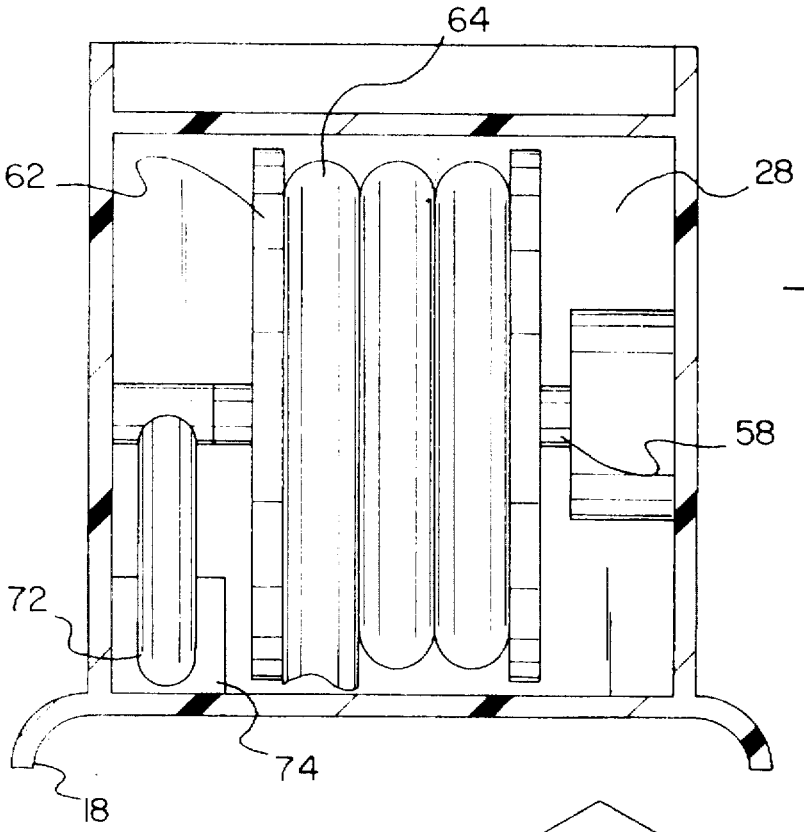
FIG. 4 is a cross-sectional view of the present invention taken along line 4—4 of FIG. 2.

As best illustrated in FIG. 4, a tension rod 58 is mounted within the storage compartment 28. The tension rod has a wheel 62 coupled thereto and capable of rotating with the rotation of the tension rod. The wheel is sized to have a hose 64 wound therearound. The tension rod allows the hose to be uncoiled and automatically recoiled about the wheel when pulled and released by a user.

The hose 64 has an exterior end 66 that is coupled with a sprayer head 68 and an interior end 72. As depicted in FIG. 4, the interior end is coupled to a pump means 74. The pump means is mounted onto the interior wall of the housing member as seen in FIG. 4. The pump means is capable of drawing water from within the water tank 26 for release through the sprayer when coupled with the hose.

Figure 5:
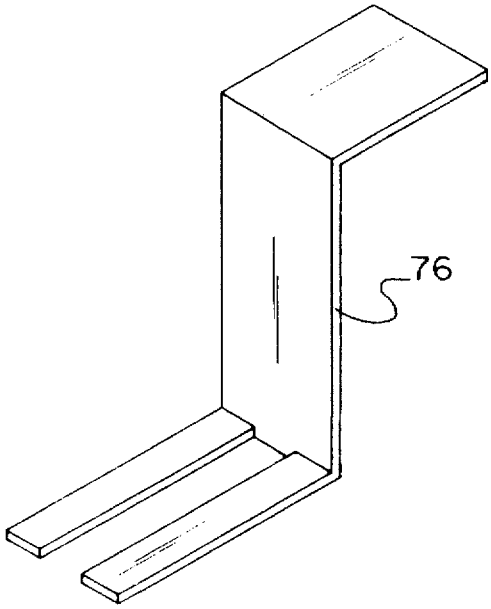
FIG. 5 is an isometric view of the U-clip of the present invention.

Lastly, a U-clip 76, as depicted in FIG. 5, is provided. The U-clip is coupled to a side of the toilet tank and secured in position by the weight of toilet tank's lid 78, as shown in FIG. 1. The U-clip supports the sprayer of the hose between uses.

The present invention heated bidet device is structured to be added the user's existing toilet. The device has a main housing member that has a two-gallon storage tank and a storage compartment. The storage compartment houses the hose that delivers the water for personal hygiene cleaning. The entire device is seated on top of the existing toilet tank lid. The device has a lower extent projecting downwardly from each side wall of the housing member. The lower extents hold the device in position. An immersion heating element is positioned in the water tank. The heating element will heat the water into the tank prior to use. Water enters the tank by way of an elongated water line that connects with the toilet's existing water line. Water is pumped out of the tank by way of the hose.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A heated bidet device for use with an existing toilet having a toilet tank with a lid and a toilet tank water supply line connected to the toilet tank comprising, in combination:

a generally rectangular housing member arranged for sitting on top of the toilet tank, the housing member having an interior wall forming a water tank and a storage compartment within the housing member, the water tank of the housing member having an upper peripheral flange therearound and an upright being adjacent the peripheral flange, a lid positioned over the water tank for engaging the upright, the storage compartment having a door hingably mounted to a side thereof;

an elongated water line having a first end adapted to be coupled to the toilet tank water supply line and a second end coupled to the water tank, the elongated water line carrying water from the toilet tank water supply line to the water tank;

a means for heating the water stored within the water tank;

a hose having an exterior end being coupled with a sprayer head and an interior end being coupled to a pump means, the pump means being mounted onto the interior wall of the housing member, the pump means moving water from within the water tank through the hose and sprayer head;

a tension rod being mounted within the storage compartment, the tension rod having a wheel coupled thereto, the wheel being sized for having the hose wound therearound, the tension rod allowing the hose to be uncoiled and automatically recoiled about the wheel when pulled and released by a user; and, a U-clip adapted to be coupled to a side of the toilet tank and secured in position by the weight of the toilet tank lid, the U-clip supporting the sprayer head of the hose between uses.

2. A heated bidet device for use with an existing commode having a toilet tank with a lid and a toilet tank water supply line connected to the toilet tank comprising:

a housing member arranged for sitting on top of the toilet tank, the housing member having a planar interior wall forming a water tank and a storage compartment within said housing member;

an elongated water line having a first end adapted to be coupled to the toilet tank water supply line proximate the connection between the toilet water tank water supply line and the toilet tank and a second end coupled to the water tank, the elongated water line carrying water from the toilet tank water supply line to the water tank while the housing member is sitting on top of the toilet tank;

a means for heating the water stored within the water tank;

a hose connected to a pump means, said pump means mounted on said planar interior wall, said pump means moving water from within the water tank through the hose; and, a tension rod being mounted within the storage compartment for retractably supporting the hose therein.

3. The heated bidet device as set forth in claim 2, wherein the water tank of the housing member having an upper peripheral flange therearound and an upright being adjacent the peripheral flange, and a lid being positioned over the water tank and capable of engaging the upright.

4. The heated bidet device as set forth in claim 2, wherein the storage compartment having a door hingably mounted to a side thereof.

5. The heated bidet device as set forth in claim 2, wherein the tension rod having a wheel coupled thereto and the wheel being sized for having the hose wound therearound.

6. The heated bidet device as set forth in claim 5, wherein the tension rod allowing the hose to be uncoiled and automatically recoiled about the wheel when pulled and released by a user.

7. The heated bidet device as set forth in claim 2, wherein the hose having an exterior end being coupled with a sprayer head and the hose having an interior end coupled with the pump means.

8. The heated bidet device as set forth in claim 7, wherein the pump means being mounted to the interior wall of the housing member and capable of drawing water from within the water tank for release through the sprayer head.

9. The heated bidet device as set forth in claim 2, including a U-clip adapted to be coupled to a side of the toilet tank and secured in position by the weight of the toilet tank lid, and the U-clip supporting an end of the hose between uses.

* * * * *